United States Patent [19]

Trotta

[11] 4,198,746

[45] Apr. 22, 1980

[54] ALL PLASTIC SWIVEL HEAD RAZOR HANDLE

[75] Inventor: Robert A. Trotta, Winthrop, Mass.

[73] Assignee: The Gillette Company, Boston, Mass.

[21] Appl. No.: 943,248

[22] Filed: Sep. 18, 1978

Related U.S. Application Data

[63] Continuation of Ser. No. 805,137, Jun. 9, 1977, abandoned.

[51] Int. Cl.[2] ..... B26B 21/06

[52] U.S. Cl. ..... 30/47; 30/85

[58] Field of Search ..... 30/47, 50, 51, 57, 85, 30/87, 89

[56] References Cited

U.S. PATENT DOCUMENTS

| | | | |
|---|---|---|---|
| 3,918,155 | 11/1975 | Atkins | 30/47 |
| 3,975,820 | 8/1976 | Torance | 30/47 |
| 4,026,016 | 5/1977 | Nissen | 30/47 |
| 4,083,104 | 4/1978 | Nissen | 30/47 |

FOREIGN PATENT DOCUMENTS

| | | | |
|---|---|---|---|
| 1294666 | 11/1972 | United Kingdom | 30/85 |

*Primary Examiner*—Gary L. Smith

*Attorney, Agent, or Firm*—Richard A. Wise; Scott R. Foster

[57] ABSTRACT

A razor handle comprising a grip portion having arms at one end thereof for pivotally mounting thereon a shaving unit of the type in which a blade and guard are permanently fixed together, the shaving unit being free to pivot upon the handle during a shaving operation, the handle having spring structure thereon for biasing the pivotally movable shaving unit toward a central position, and structure permitting release of the shaving unit and engagement with a new shaving unit.

1 Claim, 5 Drawing Figures

ALL PLASTIC SWIVEL HEAD RAZOR HANDLE

CROSS-REFERENCE TO RELATED APPLICATION

This is a continuation of application Ser. No. 805,137, filed June 9, 1977, in the name of Robert A. Trotta, now abandoned.

BACKGROUND OF THE INVENTION

1. Field of the Invention

The invention relates to wet shaving implements and is directed more particularly to a razor handle adapted to receive and retain a shaving unit of the type having a blade and guard permanently fixed together.

2. Description of the Prior Art

It is known to mount on a razor handle of the type shown in U.S. Pat. No. 3,768,162 shaving units of the type disclosed and described in U.S. Pat. Nos. 3,703,764; 3,724,070 and 3,832,774.

A modification of the shaving unit and handle system shown in the above-mentioned patents appears in U.S. patent application Ser. No. 576,253, filed May 12, 1975, in the name of Warren I. Nissen, now U.S. Pat. No. 4,026,016; and Ser. No. 576,254, filed May 12, 1975 in the names of Warren I. Nissen et al, now U.S. Pat. No. 4,083,104, which show respectively, a shaving unit and handle in which the shaving unit is pivotally mounted on one end of the handle. A used shaving unit may be released from the handle and a new shaving unit connected thereto.

U.S. patent application Ser. No. 576,252, filed May 12, 1975, in the name of Robert A. Trotta, now abandoned, shows a disposable razor assembly including a one-piece molded handle and a pivotally mounted shaving unit thereon, it being intended that the whole assembly be disposed of upon dulling of the cutting edge of the blade means.

U.S. patent application Ser. No. 750,958, filed Dec. 15, 1976. in the name of Robert A. Trotta, now U.S. Pat. No. 4,094,063 shows an improved disposable razor assembly including a one-piece molded handle and a pivotally mounted shaving unit thereon, it being intended that the whole assembly be disposed of upon dulling of the cutting edge of the blade means.

SUMMARY OF THE INVENTION

An object of the present invention is to provide an all plastic razor handle assembly adapted to receive and retain a shaving unit mounted thereon for pivotal movement and to release said shaving unit upon dulling of the cutting edge portion thereof for replacement by a new shaving unit.

A further object of the invention is to provide such a razor handle assembly which is simple in construction, economical to manufacture, and easy to operate.

With the above and other objects in view, as will hereinafter appear, a feature of the present invention is the provision of a razor comprising a handle having at one end thereof arm means with mounting means thereon for pivotally mounting a shaving unit therebetween, and spring means extending from the handle for engagement with the shaving unit to exert a biasing force on the shaving unit, and a cam portion disposed in the handle and movable therein to a position in which the cam portion engages the arm means to force apart the arm means to release a shaving unit held by the arm means and position the arm means for acceptance of a new shaving unit, reversed movement of the cam portion disengaging the arm means to permit the arm means to engage the new shaving unit.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which it novel features and advantages will be apparent.

Figure 1:
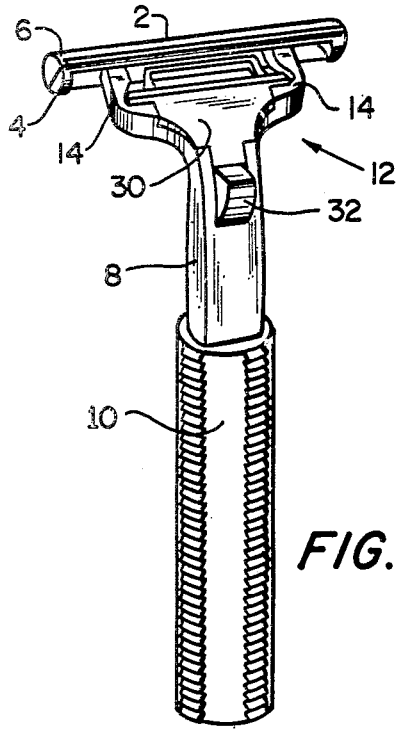
FIG. 1 is a perspective view of one form of razor illustrative of an embodiment of the invention.

Referring to the drawings, it will be seen that the illustrative razor assembly is adapted to receive and retain a shaving unit 2 of the type fully disclosed and described in U.S. patent application Ser. No. 576,253, filed May 12, 1975. The shaving unit includes a platform member 4 having a guard means and on which is disposed a blade means and thereon a cap member 6. The cap and platform members are fixed together with the blade means disposed therebetween. The shaving unit is provided with journal bearings and cam means, as fully disclosed and described in the above-mentioned patent application. The blade means may comprise more than one blade, if desired, and if so, may also include spacer means separating the two blades. The journal bearings of the shaving unit constitute a pivotal mounting means by which the shaving unit is pivotally mounted on the handle.

Figure 5:
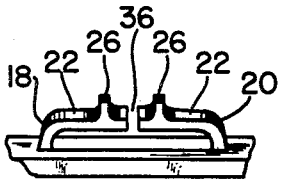
FIG. 5 is a partial perspective view of an alternative embodiment.

Referring to FIG. 1, it will be seen that the razor handle 8 comprises a grip portion 10 and a head portion 12. The head portion 12 is provided with arms 14 provided with journals 16 which constitute pivotal mounting means complimental to the pivotal mounting means of the shaving unit 2. The head portion 12 further includes first and second supports 18, 20 interconnected by a resilient bridge means 22 which constitutes a leaf spring anchored at either end thereof. The mid-portion of the bridge means 22 is provided with cam follower means 24 and stop means 26 on either side of the cam follower means 24. Alternatively, as seen in FIG. 5, the cam follower portion may be split, as at 36.

Figure 4:
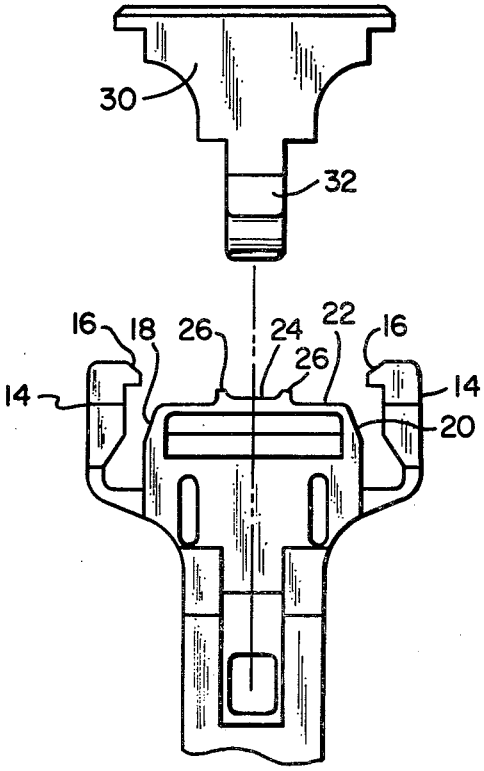
FIG. 4 is an exploded perspective view of the head portion of the razor shown in the preceding figures, this Fig. showing particularly the cam member included in the razor assembly.

The arms 14 are molded integrally with the handle 8 (FIG. 4) and are sufficiently narrow at their juncture with the head portion 12 to permit a slight flexing outwardly in order to receive the shaving unit 2 therebetween. The plastic material of the razor handle 8, and therefore the arms 14, is on the other hand, sufficiently rigid so that the arms 14 are not likely to be opened by an accidental fall so as to release the shaving unit 2 held therebetween.

Figure 2:
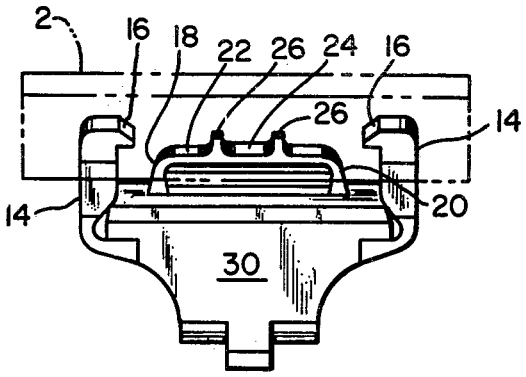
FIG. 2 is a perspective view of a head portion of the razor shown in FIG. 1, and showing in phantom a shaving unit.
Figure 3:
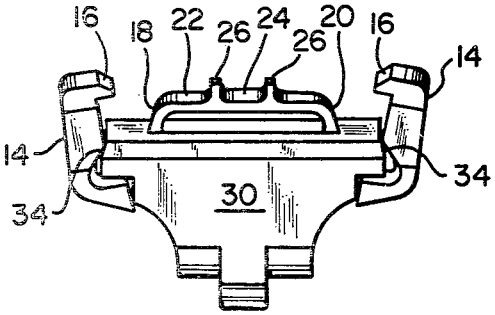
FIG. 3 is a perspective view of the head portion of the razor shown in FIGS. 1 and 2, the arm means of the razor being shown in the "open" position.

Referring to FIG. 1, it will be seen that the handle 8 is provided with a cam member 30 having a pusher portion 32 molded integrally therewith. When acted upon by an operator, as by an operator's pressing against the pusher portion 32, the cam member 30 is slidable in the handle 8 from a position as shown in FIG. 2 to a position as shown in FIG. 3 wherein cam surfaces 34 of the cam member 30 act upon the arm portions 14 to force the arm portions 14 outwardly away from each other to release a shaving unit 2 held therebetween. Release of the pusher portion 32 of the cam member 30 permits the semi-resilient arm members 14 to exert a reverse pressure upon the cam member 30 to urge the cam member 30 back to the position shown in FIG. 2.

In use, the shaving unit 2 is free to pivot upon the journals 16 of the arms 14. The shaving unit 2 is engaged by the cam follower means 24 and urged thereby to a central or neutral position. The stop means 26 assist in retaining the cartridge 2 in a centralized position lengthwise of the shaving unit. During a shaving operation, pivoting movement of the shaving unit causes commensurate movement of the cam follower means 24, forcing the bridge portion 22 to flex. The resilient nature of the bridge portion 22, however, exercises a bias against the shaving unit to return the shaving unit to a central position. When it is desired to change shaving units, the operator need only exert pressure upon the pusher portion 32 of the cam member 30 to move the cam member 30 in the handle 8 to a position in which the cam surfaces 34 force apart the arm portions 14 to release the shaving unit held therebetween. The arm portions 14 are then brought into proximate engagement with a new shaving unit. Upon release of the pusher portion 32 by the operator, the arm portions 14 cause the cam member 30 to slide back to its dormant position, as shown in FIG. 2, and the arms 14 to spring back toward one another to engage and retain a new shaving unit therebetween.

The razor of the present invention may be considered "disposable", in that it is relatively cheaply manufactured, having only two parts, i.e. the grip portion 10 and the cam member 30, both parts being of molded plastic. However, contrary to most disposable razor products, the razor of the present invention is adapted to release a used shaving unit and accept and retain a new shaving unit for additional shaving life.

It is to be understood that the present invention is by no means limited to the particular construction herein disclosed and/or shown in the drawings, but also comprises any modifications or equivalents within the scope of the disclosure.

What I claim is:

1. A razor handle comprising a grip portion and a head portion molded integrally as a single unit, the head portion having first and second arm means molded integrally with said head portion and having mounting means thereon for pivotally mounting a shaving unit therebetween, spring means molded integrally with and extending from said head portion and adapted for engagement with said shaving unit to exert a biasing force thereon, and a cam portion disposed in said handle, said cam portion having first and second cam surfaces and being movable in said handle to a position in which said cam portion first and second cam surfaces respectively engage said first and second arm means to force apart said arm means whereby to release said shaving unit held by said arm means and position said arm means for acceptance of a new shaving unit, reverse movement of said cam portion permitting said arm means to engage said new shaving unit.

* * * * *